US011833812B2

(12) United States Patent
Tanabe et al.

(10) Patent No.: US 11,833,812 B2
(45) Date of Patent: Dec. 5, 2023

(54) PRINTING APPARATUS

(71) Applicant: FUJITSU FRONTECH LIMITED, Inagi (JP)

(72) Inventors: Hiromu Tanabe, Inagi (JP); Tsuyoshi Yamazaki, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 25 days.

(21) Appl. No.: 17/649,628

(22) Filed: Feb. 1, 2022

(65) Prior Publication Data

US 2022/0153042 A1 May 19, 2022

Related U.S. Application Data

(63) Continuation of application No. PCT/JP2019/038149, filed on Sep. 27, 2019.

(51) Int. Cl.
*B41J 11/66* (2006.01)
*B41J 3/407* (2006.01)

(52) U.S. Cl.
CPC ..... *B41J 11/663* (2013.01)

(58) Field of Classification Search
CPC ..... B41J 3/4075; B41J 15/04; B41J 11/70
See application file for complete search history.

(56) References Cited

U.S. PATENT DOCUMENTS

2010/0225723 A1 9/2010 Okazawa

FOREIGN PATENT DOCUMENTS

| | | | | |
|---|---|---|---|---|
| JP | 03224764 | A | | 10/1991 |
| JP | 2003118898 | A | | 4/2003 |
| JP | 2009131997 | A | | 6/2009 |
| JP | 2010201820 | A | | 9/2010 |
| JP | 2017024221 | A | * | 2/2017 |
| JP | 2017024221 | A | | 2/2017 |

OTHER PUBLICATIONS

Komai, MachineTranslationofJP-2017024221-A, 2017 (Year: 2017).*
Office Action issued Japanese patent application No. 2021-548117, dated Jul. 5, 2022.
Search report issued in PCT/JP2019/038149, dated Dec. 17, 2019.
Written Opinion of the International Searching Authority of PCT/JP2019/038149, dated Dec. 17, 2019.
Office Action issued in corresponding Chinese patent application No. 201980099988.2, dated Feb. 15, 2023.

* cited by examiner

*Primary Examiner* — Scott A Richmond
(74) *Attorney, Agent, or Firm* — Greer Burns & Crain Ltd.

(57) ABSTRACT

A printing apparatus includes: a first conveyor that unspools a rolled-up medium for transport; a print head that prints on the medium; a cutter that cuts off, from the medium, a printed portion on which printing has been performed by the print head; a second conveyor that transports, in a sandwiching manner, the printed portion cut off by the cutter; a drive that drives at least the first conveyor; and a processor that controls the drive, wherein after the printed portion is cut off by the cutter and before printing is started by the print head, the processor controls the drive such that the first conveyor transports the medium in an ejection direction to a position where the medium is sandwiched by the second conveyor.

2 Claims, 10 Drawing Sheets

PRINTING APPARATUS

CROSS-REFERENCE TO RELATED APPLICATION

This application is continuation application of International Application PCT/JP2019/038149 filed on Sep. 27 2019 and designated the U.S., the entire contents of which are incorporated herein by reference.

FIELD OF THE INVENTION

The embodiments discussed herein are related to a printing apparatus that prints on a medium.

BACKGROUND OF THE INVENTION

Printing apparatuses such as airline printers have conventionally been such that a medium, such as one for forming luggage tags or receipts, which has been rolled up is unspooled so as to be transported and subjected to printing by a print head. A printed portion on which printing has been performed is cut off from the medium by a cutter and ejected by a pair of ejection rollers. Meanwhile, the medium from which the printed portion has been cut off is transported in a reverse direction opposite to an ejection direction such that, before the next printing starts, the leading end portion of the medium returns to a position at which the print head performs printing.

With respect to such printing apparatuses, a proposed apparatus does not perform transport in a reverse direction to return the leading end portion of a roll sheet to a print position, but holds the cut face of the roll sheet still in an ejection transport path in order to prevent a fault such as a jam error resulting from a deformation of the cut face (see, for example, Japanese Laid-open Patent Publication No. 2009-131997).

With respect to feeding apparatuses that can be attached to and detached from a printing apparatus, a proposed feeding apparatus includes a feeding mechanism that increases a feeding rate when a sag in a medium is detected (see, for example, Japanese Laid-open Patent Publication No. 2003-118898).

BRIEF SUMMARY OF THE INVENTION

A disclosed printing apparatus includes: a first conveyor that unspools a rolled-up medium for transport; a print head that prints on the medium; a cutter that cuts off, from the medium, a printed portion on which printing has been performed by the print head; a second conveyor that transports, in a sandwiching manner, the printed portion cut off by the cutter; a drive that drives at least the first conveyor; and a processor that controls the drive, wherein after the printed portion is cut off by the cutter and before printing is started by the print head, the processor controls the drive such that the first conveyor transports the medium in an ejection direction to a position where the medium is sandwiched by the second conveyor.

The object and advantages of the present invention will be realized by the elements set forth in the claims or combinations thereof.

DETAILED DESCRIPTION OF THE INVENTION

Figure 1:
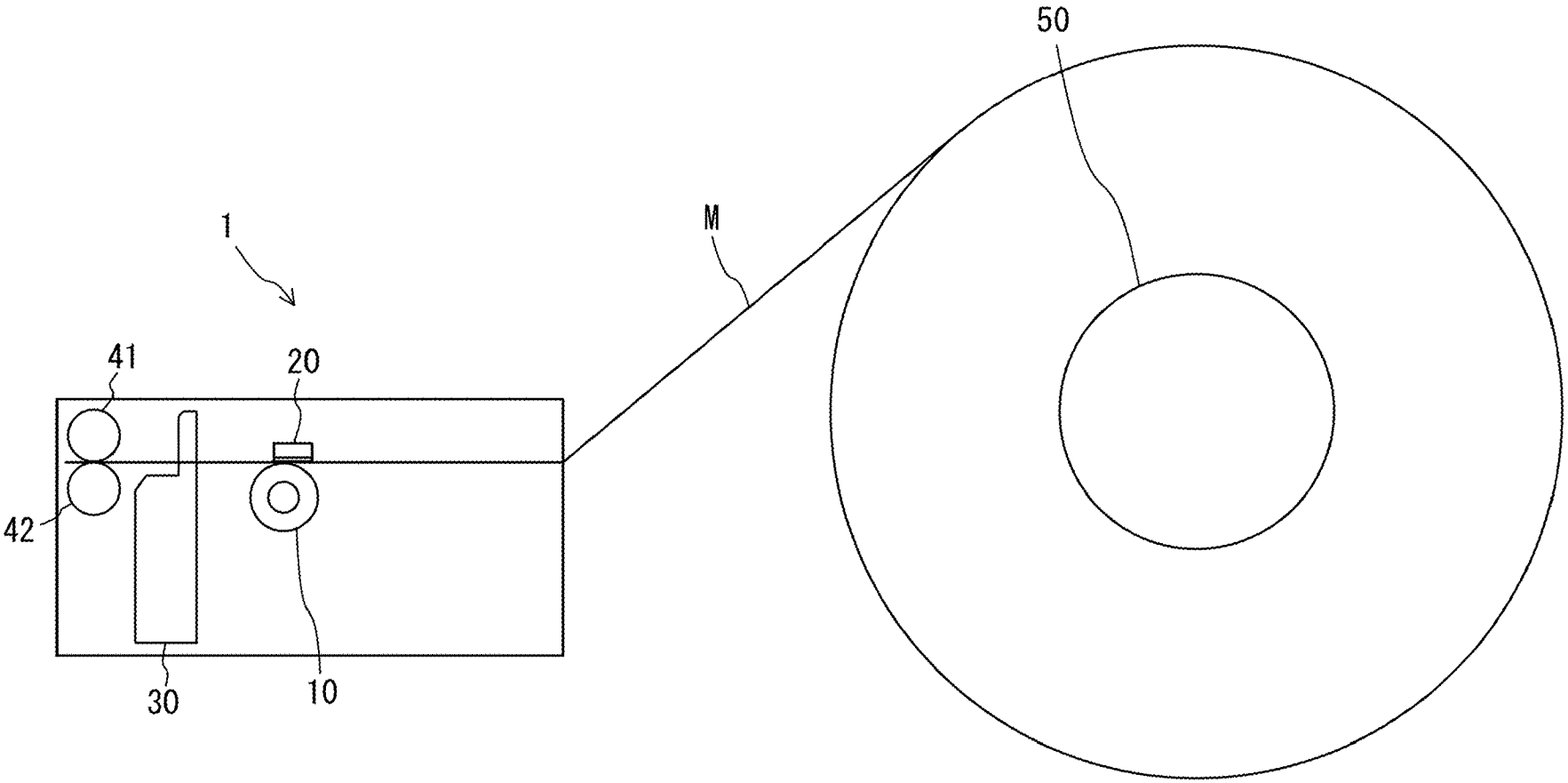
FIG. 1 is a side view illustrating the internal structure of a printing apparatus in accordance with an embodiment.

In the meantime, a medium M will have a sagging portion when being transported in a reverse direction opposite to an ejection direction after a printed portion is cut off. Afterward, an impact will be given to the medium when resolving the sagging portion by the medium being transported in the ejection direction. The roll of a medium used by a printing apparatus desirably has a large outer diameter to decrease the number of times replacement is performed. However, the larger the outer diameter of a roll is, the stronger the impact given to the medium will be.

The impact given to a medium will cause a printing failure (printing irregularity), e.g., printing shrinkage, on the medium. Such a printing failure is considered to be caused by the medium slipping due to the impact.

The following describes a printing apparatus in accordance with an embodiment of the present invention by referring to the drawings.

FIG. 1 is a side view illustrating the internal structure of a printing apparatus 1.

Figure 2:
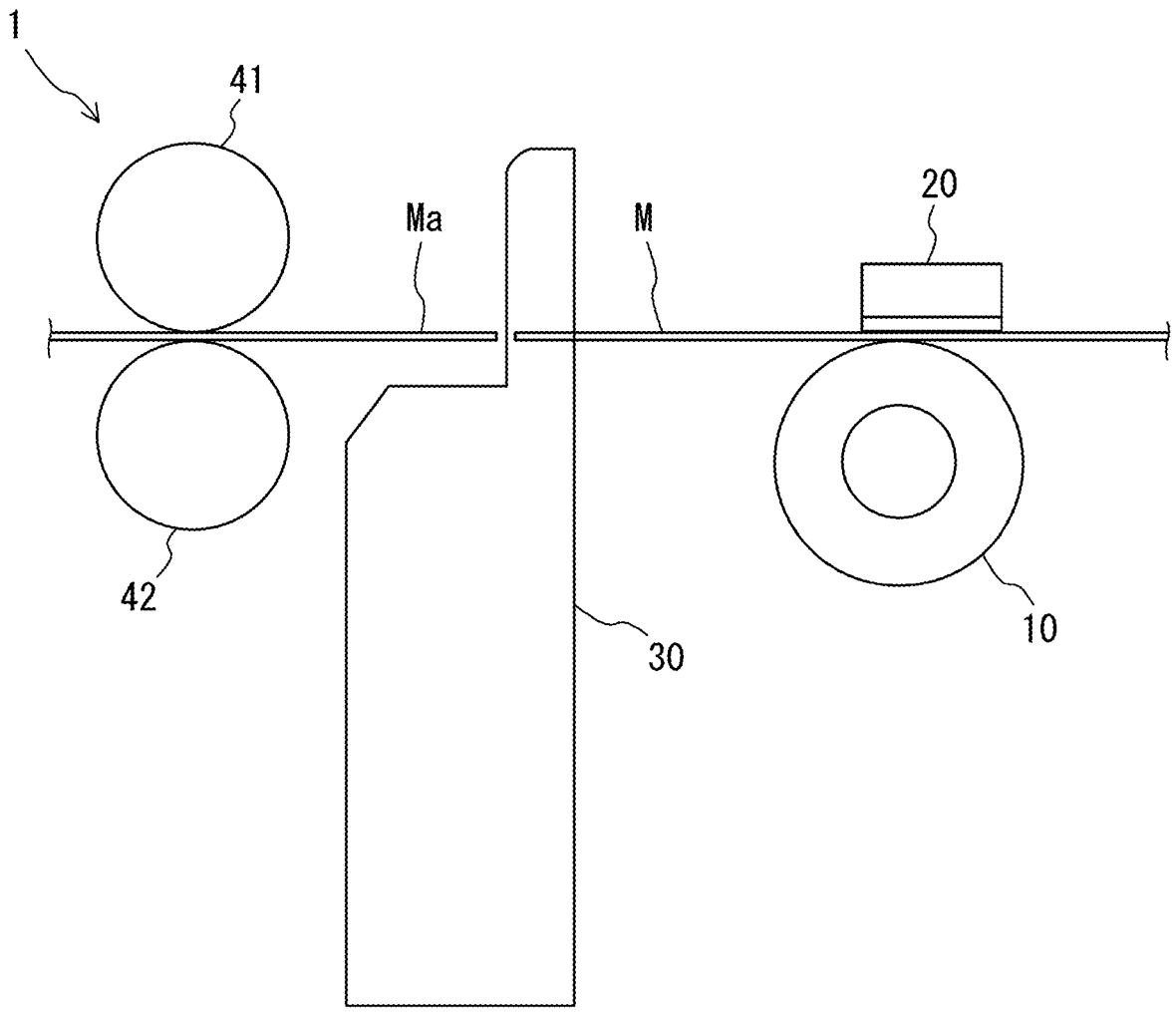
FIG. 2 is a side view illustrating the internal structure of portions of a printing apparatus in accordance with an embodiment.

FIG. 2 is a side view illustrating the internal structure of portions of the printing apparatus 1.

Figure 3:
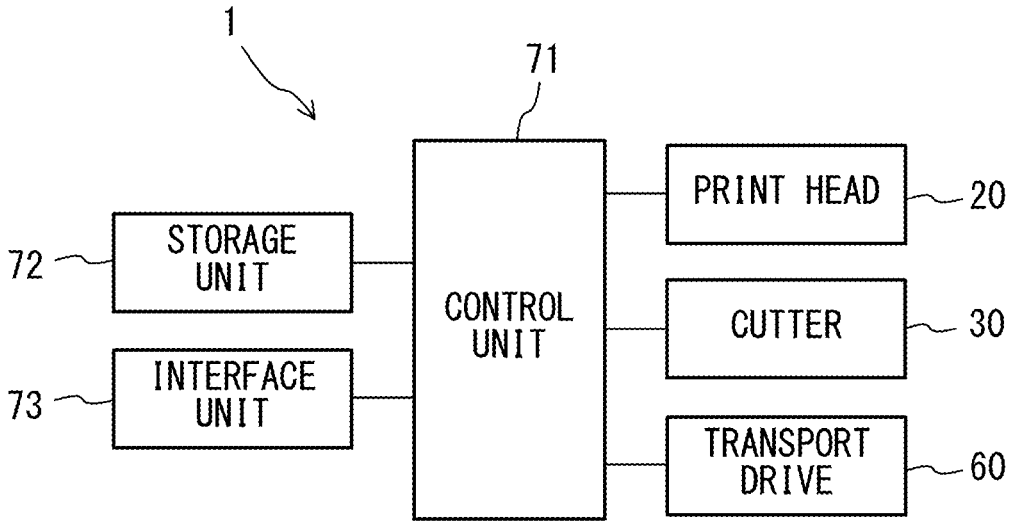
FIG. 3 illustrates the control configuration of a printing apparatus in accordance with an embodiment.

FIG. 3 illustrates the control configuration of the printing apparatus 1.

As depicted in FIG. 1, the printing apparatus 1 includes a platen roller 10, i.e., an example of a first conveyor, a print head 20, a cutter 30, a pair of ejection rollers 41 and 42, i.e., an example of a second conveyor, and a roll shaft 50. As depicted in FIG. 3, the printing apparatus 1 further includes a transport drive (drive) 60, a control unit 71, a storage unit 72, and an interface unit 73.

The platen roller 10 rotates by being driven by the transport drive 60 (described hereinafter) so as to transport a long medium M. For example, the platen roller 10 may be a rubber roller. The platen roller 10 is an example of the first conveyor, which unspools a rolled-up long medium M for transport. However, the first conveyor may be a transport roller or a transport belt other than the platen roller 10.

Figure 5:
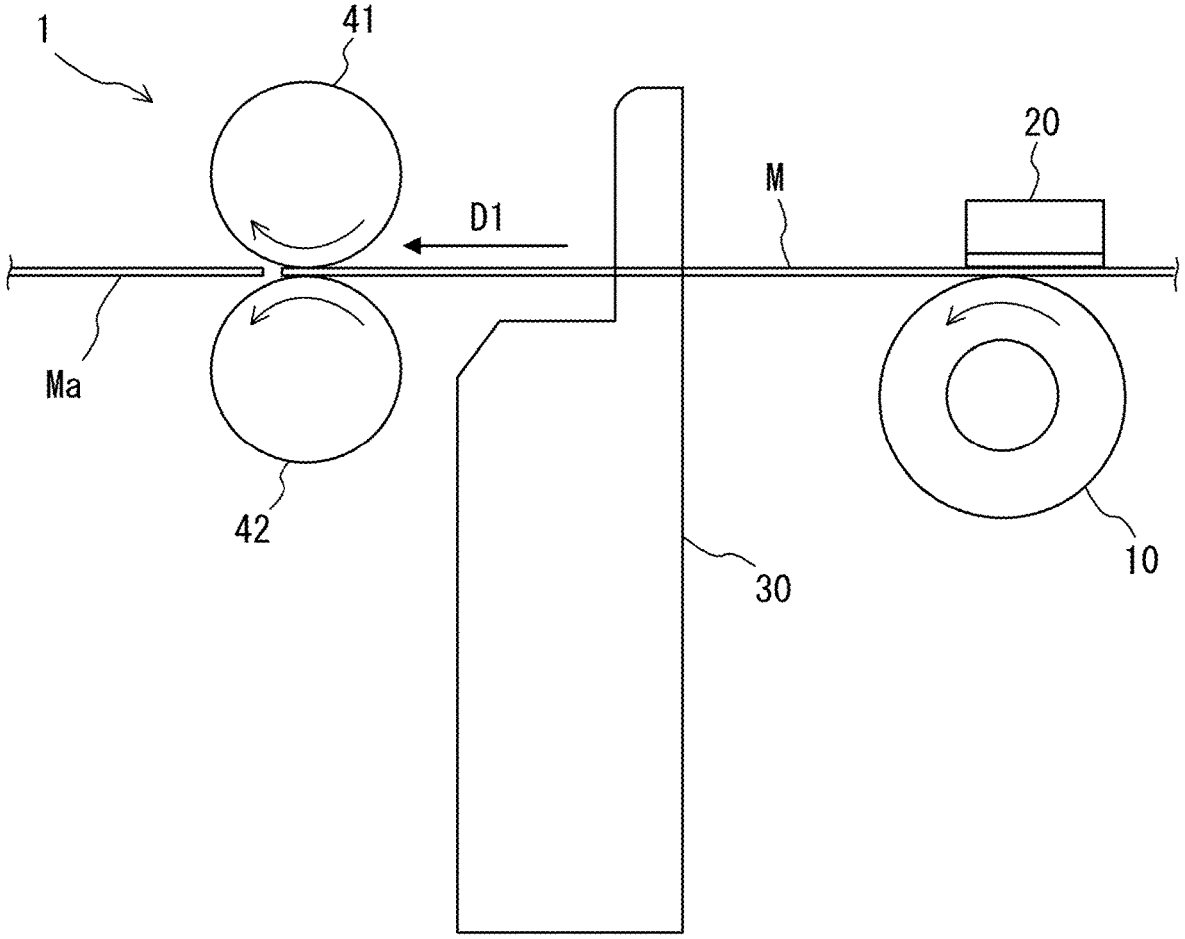
FIG. 5 is a side view for illustrating transport control performed by a printing apparatus in accordance with an embodiment (example 1)
Figure 6:
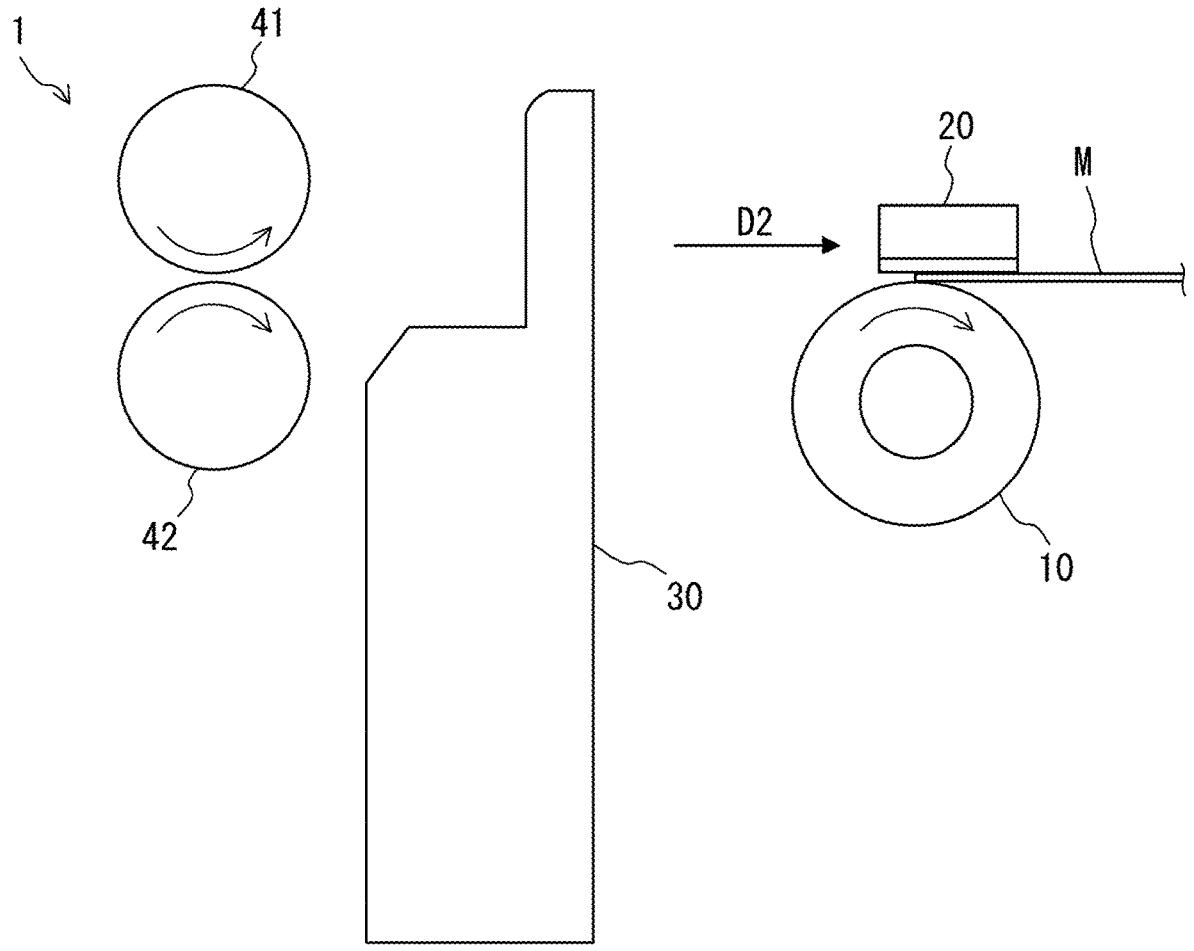
FIG. 6 is a side view for illustrating transport control performed by a printing apparatus in accordance with an embodiment (example 2)

For example, the medium M may be wound in a roll shape with an outer diameter of 200 mm and rotatably supported by the roll shaft 50 (described hereinafter) at an axial core. An example of the medium M may be one for forming labels that each include an adhesive layer on one surface (front surface) or inside thereof and are used as luggage tags by an airline printer. As depicted in FIG. 5 (described hereinafter), the rolled-up medium M is unspooled for transport in a rotation direction D1 by rotation of the platen roller 10. As depicted in FIG. 6, when the platen roller 10 is reversely rotated, the medium M is transported in a reverse direction D2 opposite to the ejection direction D1.

The print head 20 is disposed to face the platen roller 10. The print head 20 prints on a medium M sandwiched by the platen roller 10 and the print head 20. The printing scheme of the print head 20 is not particularly limited and may be, for example, a thermal sensing scheme. When the printing scheme of the print head 20 is a thermal sensing scheme, the medium M is, for example, a thermosensitive label.

As depicted in FIG. 2, the cutter 30 cuts off a printed portion Ma of the medium M on which the print head 20 has performed printing.

The pair of ejection rollers 41 and 42 are disposed to face each other and transport, in a sandwiching manner, the printed portion M cut off by the cutter 30. Among the pair of ejection rollers 41 and 42, the ejection roller 41 is a driving roller that rotates by being driven by the transport drive 60 (described hereinafter), and the ejection roller 42 is a driven roller. The pair of ejection rollers 41 and 42 may constitute an example of a second conveyor. Alternatively, an ejection belt may be used as the second conveyor.

As described above, the roll shaft 50 depicted in FIG. 1 rotatably supports the rolled-up medium M at the axial core of this medium.

For example, the transport drive 60 depicted in FIG. 3 may be a motor that drives the ejection roller 41 and the platen roller 10. Thus, the pair of ejection rollers 41 and 42 and the platen roller 10 rotate at the same timing. In one possible example, a transport drive for driving the ejection roller 41, i.e., a driving roller, and a transport drive for driving the platen roller 10 may be individually disposed.

The control unit 71 controls the print head 20, a cutter drive provided for the cutter 30, and the transport drive 60. For example, the control unit 71 may include a processor (e.g., central processing unit: CPU) that reads and executes a program stored in the storage unit 72.

For example, the storage unit 72 may be a read only memory (ROM) constituting a read-only semiconductor memory storing a program to be executed by the processor of the control unit 71, or a random access memory (RAM) constituting a randomly writable/readable semiconductor memory used as a working storage region on an as-needed basis when the processor executes various programs.

The interface unit 73 communicates various information with external devices. For example, the interface unit 73 may obtain a program to be executed by the processor from a storage medium or via a network, or receive print data from a computer that generates the same.

The following describes transport control performed by the printing apparatus 1 by referring to FIGS. 4-10.

Figure 4:
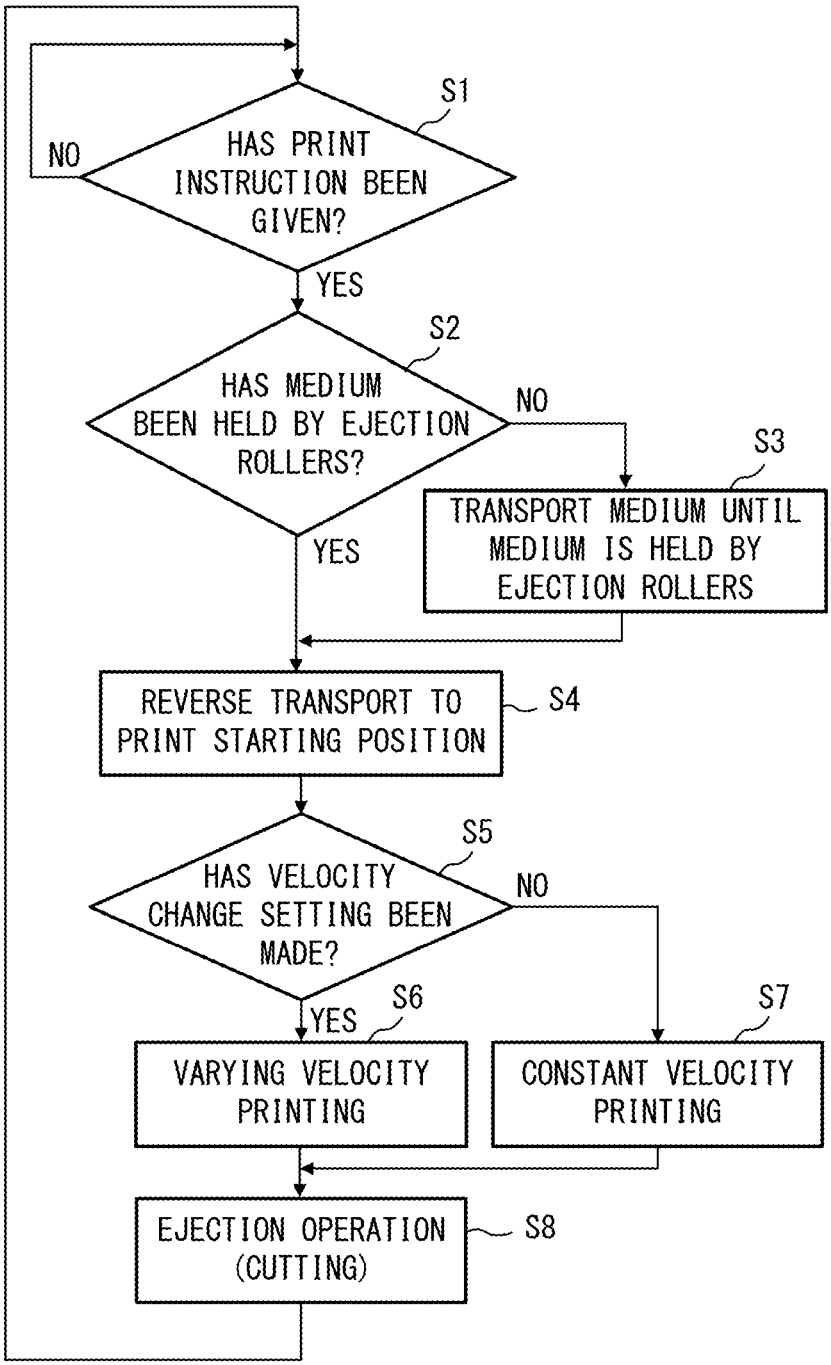
FIG. 4 is a flowchart for illustrating transport control performed by a printing apparatus in accordance with an embodiment.

FIG. 4 is a flowchart for illustrating the transport control performed by the printing apparatus 1.

FIGS. 5 and 6 are side views for illustrating the transport control performed by the printing apparatus 1.

Figure 7:
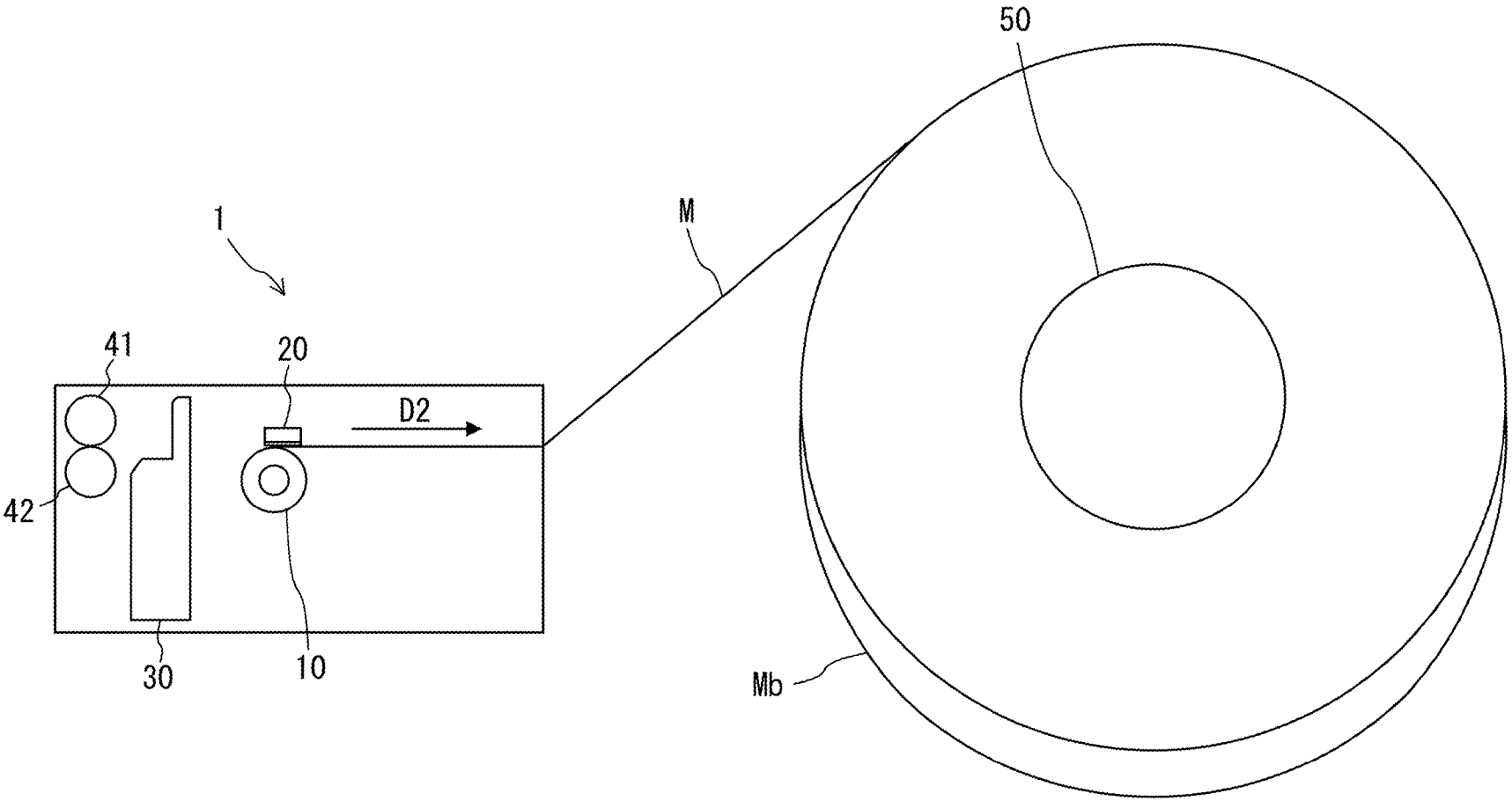
FIG. 7 is a side view illustrating the internal structure of a printing apparatus in accordance with an embodiment, with a medium sagging.

FIG. 7 is a side view illustrating the internal structure of the printing apparatus 1, with a medium M sagging.

Figure 8:
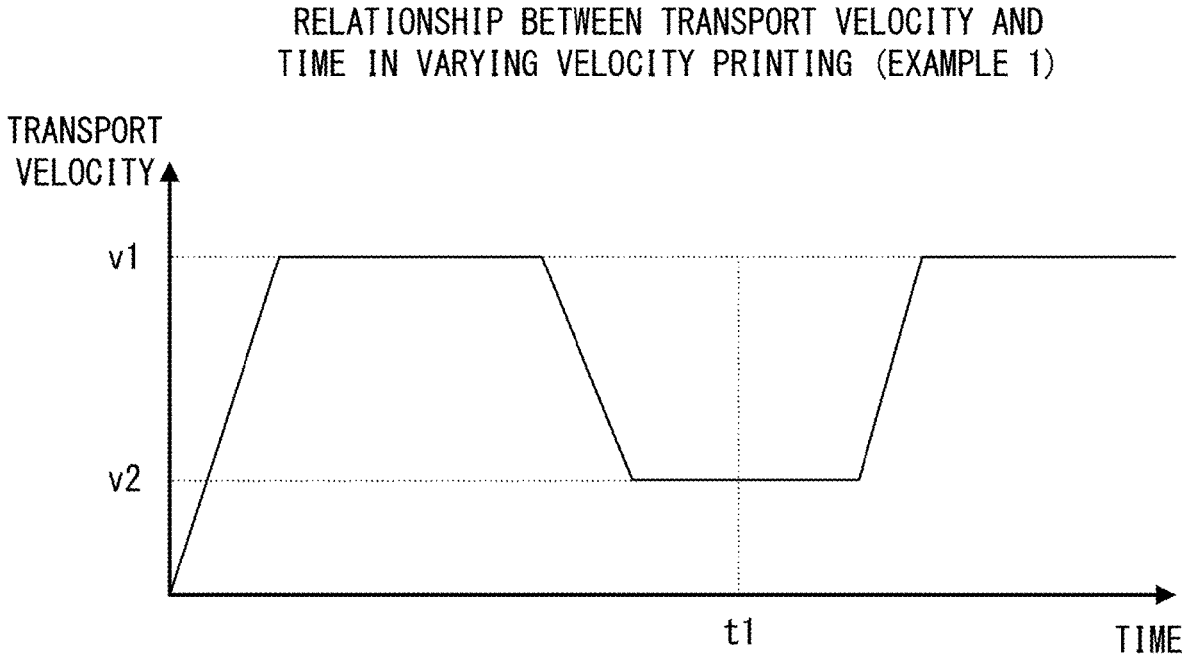
FIG. 8 illustrates a relationship between a transport velocity and time in varying velocity printing in an embodiment (example 1)

FIG. 8 illustrates a relationship between a transport velocity and time in varying velocity printing (example 1).

Figure 9:
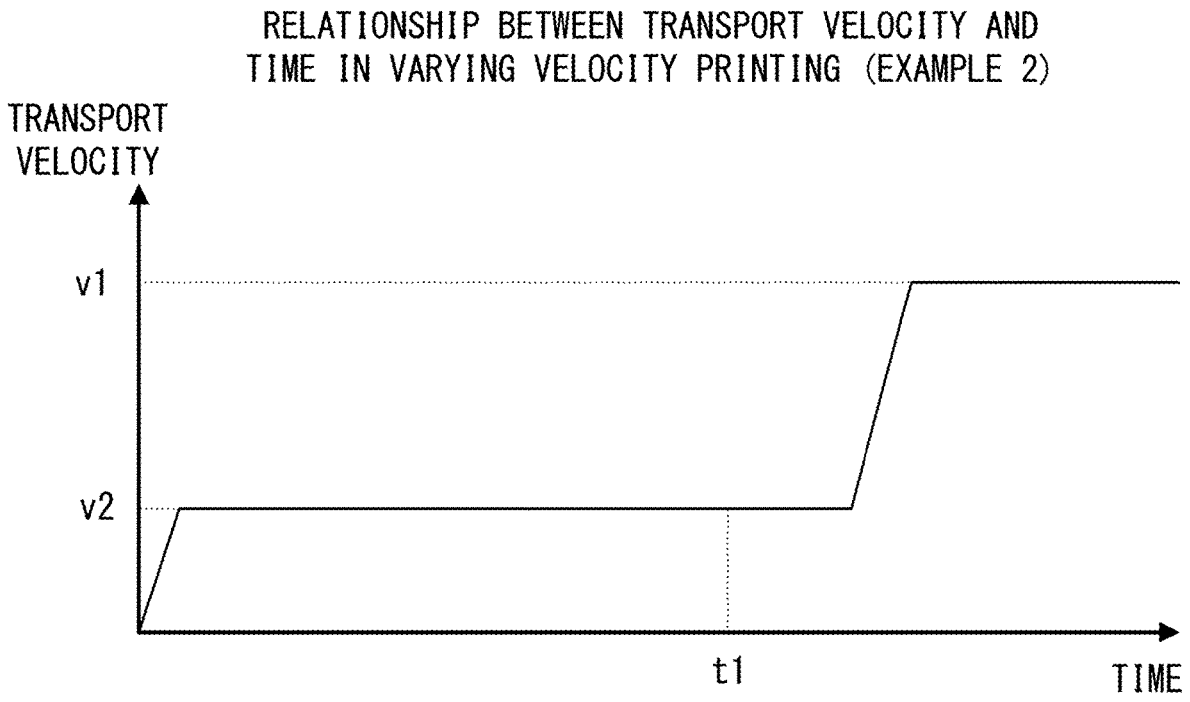
FIG. 9 illustrates a relationship between a transport velocity and time in varying velocity printing in an embodiment (example 2)

FIG. 9 illustrates a relationship between a transport velocity and time in varying velocity printing (example 2).

Figure 10:
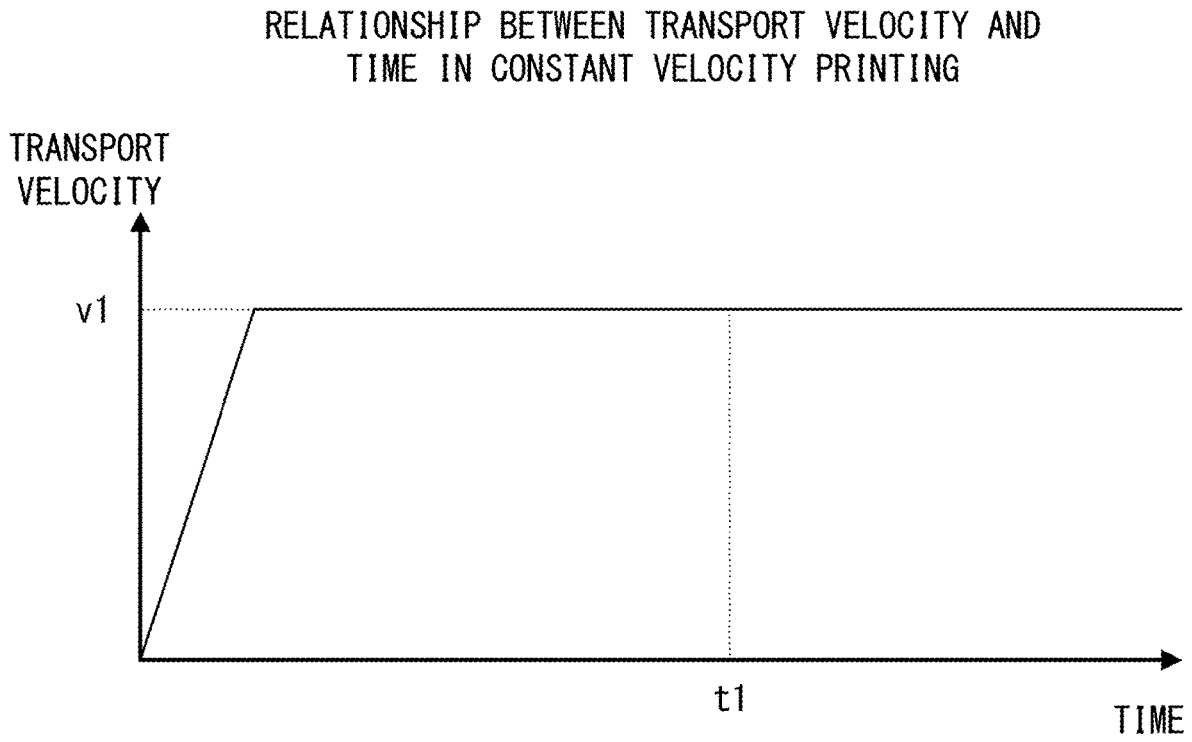
FIG. 10 illustrates a relationship between a transport velocity and time in constant velocity printing in an embodiment.

FIG. 10 illustrates a relationship between a transport velocity and time in constant velocity printing.

First, as indicated in FIG. 4, on the basis of an operation performed on the printing apparatus 1 by the user or information received from a computer that generates print data, the control unit 71 depicted in FIG. 3 repeatedly determines whether an instruction to start next printing by the print head 20 has been given (step S1), until such a start instruction is given.

After receiving an instruction to start the next printing (step S1: YES), the control unit 71 determines whether, as depicted in FIG. 5, a medium M has been held by being sandwiched by the pair of ejection rollers 41 and 42 (step S2). In this determination process, for example, the determination may be made in accordance with whether an operation for transporting the medium M in the ejection direction D1 to a position where the medium M is sandwiched by the pair of ejection rollers 41 and 42 was performed in an ejection operation process (step S8) (described hereinafter). However, the control unit 71 may determine, on the basis of a sensing result provided by a sensor for sensing the medium M, whether the medium M has been held by being sandwiched by the pair of ejection rollers 41 and 42.

Only when determining that the medium M has not been held by being sandwiched by the pair of ejection rollers 41 and 42 (step S2: NO), the control unit 71 controls the transport drive 60 such that the platen roller 10 transports the medium M in the ejection direction D1 to the position where the medium M is sandwiched by the pair of ejection rollers 44 and 42 (step S3).

Then, the control unit 71 controls the transport drive 60 such that the platen roller 10 transports the medium M in the reverse direction D2 opposite to the ejection direction D1 until, as depicted in FIG. 6, the leading end portion of the medium M (the upstream-side end portion in the reverse direction D2, i.e., the downstream-side end portion in the ejection direction D1) arrives at a position between the platen roller 10 and the print head 20 (step S4), thereby allowing the next printing to be performed starting from the leading end portion of the medium M. The control unit 71 obtains print data when the medium M is transported in the reverse direction D2. The reverse transport process (step S4) may be performed directly after the ejection operation (step S8). In this case, in the determination process in step S2, the control unit 71 may determine whether the reverse transport process has been performed after the medium M was sandwiched by the pair of ejection rollers 41 and 42.

Next, the control unit 71 determines whether a velocity change setting for setting, as described hereinafter, a low transport velocity for the medium M when an impact is given to the medium M has been made (step S5). For example, the velocity change setting may be made on the basis of an operation performed on the printing apparatus 1 by the user or information received from a computer that generates print data. The velocity change setting is intended to set a low transport velocity when an impact is given to the medium M upon a sagging portion (loose portion) Mb that is made in the medium M as depicted in FIG. 7 through transport of the medium M in the reverse direction D2 as illustrated in FIG. 6 being resolved through transport of the medium M in the ejection direction D1 during printing. As described above, the medium M is transported in the reverse direction D2 after being transported in the ejection direction D1 to a position where the medium M is sandwiched by the pair of ejection rollers 41 and 42 depicted in FIG. 6. Hence, an impact is given to the medium M due to the resolving of the sagging portion Mb, while the medium M is sandwiched by the pair of ejection rollers 41 and 42. Thus, the medium M receives the impact while being held between the pair of ejection rollers 41 and 42 and between the platen roller 10 and the print head 20, i.e., held at two sites. Note that the larger the outer diameter of the roll of the medium M is, the larger the impact will be.

When the velocity change setting has been made (step S5: YES), the control unit 71 causes the print head 20 to perform varying velocity printing while changing the transport velocity of the medium M (step S6). For example, after the medium M starts to be transported for printing, the control unit 71 may control the transport drive 60 such that, as depicted in FIG. 8, the transport velocity increases to a high velocity v1, then decreases to a low velocity v2 at a time t1 at which an impact is given to the medium M, and increases to the high velocity v1 again after the time t1. The print head 20 prints on the medium M in accordance with the changing transport velocity.

Alternatively, after the medium M starts to be transported for printing, the control unit 71 may perform the varying velocity printing (step S6) so as to control the transport drive 60 such that, as depicted in FIG. 9, the transport velocity increases to the low velocity v2 and increases to the high velocity v1 after the time t1 at which an impact is given to the medium M. However, keeping the high velocity v1 for a long time in transport as depicted in FIG. 8 will minimize a reduction in the printing performance that occurs when the transport velocity is the low velocity v2.

When the velocity change setting has not been made or when the printing apparatus 1 is not provided with the function for the velocity change setting (step S5: NO), the control unit 71 does not change the transport velocity of the medium M and causes the print head 20 to perform constant velocity printing (step S7). For example, after the medium M starts to be transported for printing, the control unit 71 may control the transport drive 60 such that, as depicted in FIG. 10, the transport velocity increases to the high velocity v1, and the medium M is transported at the high velocity v1 at the time t1 at which an impact is given to the medium M.

After the varying velocity printing (step S6) or the constant velocity control (step S7) is performed, the control unit 71 controls the operation for ejecting a printed portion Ma (step S8). For example, after the medium M is transported in the ejection direction D1 by the platen roller (transport drive 60) such that the rear end portion of the printed portion Ma in the ejection direction D1 (upstream-side end portion) arrives at the cutter 30 (see FIG. 2), the control unit 71 may control the cutter 30 so as to cut off the printed portion Ma. Meanwhile, as indicated in FIG. 5, the control unit 71 may control the transport drive 60 such that the platen roller 10 transports the medium M in the ejection direction D1 to a position where the medium M is sandwiched by the pair of ejection rollers 41 and 42, and holds the medium M still at this position. Then, the control unit 71 repeats the processes starting from step S1.

In the embodiment described above, the printing apparatus 1 includes the platen roller 10, i.e., an example of a first conveyor, the print head 20, the cutter 30, the pair of ejection rollers 41 and 42, i.e., an example of a second conveyor, the transport drive 60, i.e., an example of a drive, and the control unit 71, i.e., an example of a processor. The platen roller 10 unspools a rolled-up long medium M for transport. The print head 20 is disposed to face the platen roller 10 and prints on the medium M. The cutter 30 cuts off a printed portion Ma of the medium M on which the print head 20 has performed printing. The pair of ejection rollers 41 and 42 transport, in a sandwiching manner, the printed portion M cut off by the cutter 30. The transport drive 60 drives at least the platen roller 10. The control unit 71 controls the transport drive 60. After the printed portion Ma is cut off by the cutter 30 (step S8) and before the print head 20 starts printing (steps S6 and S7), the control unit 71 controls the transport drive 60 such that the platen roller 10 transports the medium M in the ejection direction D1 to a position where the medium M is sandwiched by the pair of ejection rollers 41 and 42 (step S8 or S3).

Accordingly, printing will start after the medium M is transported in the reverse direction D2 opposite to the ejection direction D1 by the platen roller 10 from the position where the medium M is sandwiched by the pair of ejection rollers 41 and 42. Thus, when the medium M is transported in the ejection direction D1 during printing, a sagging portion Mb of the medium M that has been made upon the start of the printing due to the transport in the reverse direction D2 will be resolved at a position at which the transport of the medium M in the reverse direction D2 started. At the position at which the transport in the reverse direction D2 started, the medium M is held between the pair of ejection rollers 41 and 42 and between the platen roller 10 and the print head 20, i.e., held at two sites. Hence, the medium M, while in a held state like this, can receive an impact resulting from the sagging portion Mb being resolved. Accordingly, slipping that could occur in association with the medium M receiving an impact can be suppressed, thereby allowing for suppression of an occurrence of a printing failure, e.g., printing shrinkage. As described above, the present embodiment allows for suppression of an occurrence of a printing failure on a rolled-up long medium M.

In the present embodiment, after a printed portion Ma is cut off by the cutter 30, the control unit 71 controls the transport drive 60 such that the platen roller 10 transports the medium M in the ejection direction D1 to a position where the medium M is sandwiched by the pair of ejection rollers 41 and 20, and holds the medium M still at this position; and after an instruction to start next printing by the print head 20 is received, the control unit controls the transport drive 60 such that the platen roller 10 transports the medium M in the reverse direction D2 opposite to the ejection direction D1.

In the meantime, in an aspect in which, after a printed portion Ma is cut off, the platen roller 10 transports a medium M in the reverse direction D2 to a position between the platen roller 10 and the print head 20 so as to start printing at the leading end portion of the medium M, the leading end portion of the medium M could be held on the platen roller 10 for a long time and thus pasted thereon, and the medium M could be entangled with the platen roller 10 after the printing operation starts. In the present embodiment, by contrast, as described above, after a printed portion Ma is cut off by the cutter 30, the control unit 71 causes the platen roller 10 to transport the medium M in the ejection direction D1 to the position where the medium M is sandwiched by the pair of ejection rollers 41 and 42, and hold the medium M still at this position. Thus, the leading end portion of the medium M is not held on the platen roller 10 for a long time, so that the medium M can be prevented from being entangled with the platen roller 10 after the printing operation starts, because the leading end portion of the medium M is not pasted on the platen roller 10.

In the present embodiment, in addition, after the printed portion Ma is cut off by the cutter 30, since the platen roller 10 transports the medium M in the ejection direction D1 and holds the same still, the printed portion Ma that has been cut off can be sent out for ejection by the ejection rollers 41 and 42, which are driven by the same drive source as the platen roller 10 (or the printed portion Ma can be sent out for ejection by the remaining portion of the medium M).

In the present embodiment, accordingly, the medium M can be prevented from being entangled with the platen roller 10, and the printed portion Ma (medium M) can be ejected. Furthermore, after an instruction to start the next printing by the print head 20 is received, the control unit 71 causes the platen roller 10 to transport the medium M in the reverse direction D2 opposite to the ejection direction D1, so that a reduction in the printing performance can be suppressed by performing, in parallel, the transporting in the reverse direction D2 and the receiving of print data.

In the present embodiment, after printing starts with a medium M having been transported by the platen roller in the reverse direction D2 opposite to the transport direction D1 from the position at which the medium M is sandwiched by the pair of ejection rollers 41 and 42, the control unit 71 controls the transport drive 60 such that the platen roller 10 transports the medium M in the ejection direction D1 with a transport velocity that reaches a low velocity (velocity v2) at the position at which the transport of the medium M in the reverse direction D2 started and reaches a high velocity (velocity v1) at least at another position.

Accordingly, the low velocity v2 can be set as the transport velocity of the medium M when an impact is given to the medium M at the position at which the transport of the medium M in the reverse direction D2 started, i.e., the position at which a sagging portion Mb is resolved, thereby attenuating the impact. Thus, slipping that could occur in association with the medium M receiving an impact can be further suppressed, thereby allowing for further suppression of an occurrence of a printing failure.

The present invention is not simply limited to the embodiments described herein. Components of the embodiments may be embodied in a varied manner. For example, a plurality of components disclosed with reference to the described embodiments may be combined, as appropriate, to achieve various inventions. Accordingly, various variations and applications of the invention can be provided without departing from the gist of the invention.

The invention claimed is:

1. A printing apparatus comprising:

a first conveyor that unspools a rolled-up medium for transport;

a print head that prints on the medium;

a cutter that cuts off, from the medium, a printed portion on which printing has been performed by the print head;

a second conveyor that transports, in a sandwiching manner, the printed portion cut off by the cutter;

a drive that drives at least the first conveyor; and a processor that controls the drive, wherein after the printed portion is cut off by the cutter and before printing is started by the print head, the processor controls the drive such that the first conveyor transports the medium in an ejection direction to a position where the medium is sandwiched by the second conveyor, and after printing starts with the medium having been transported by the first conveyor in a reverse direction opposite to the ejection direction from the position at which the medium is sandwiched by the second conveyor, the processor controls the drive such that the first conveyor transports the medium in the ejection direction with a transport velocity that reaches a low velocity at the position at which the transport of the medium in the reverse direction started and reaches a high velocity at least at another position.

2. The printing apparatus of claim 1, wherein after the printed portion is cut off by the cutter, the processor controls the drive such that the first conveyor transports the medium in the ejection direction to the position where the medium is sandwiched by the second conveyor, and holds the medium still at the position, and after an instruction to start next printing by the print head is received, the processor controls the drive such that the first conveyor transports the medium in the reverse direction.

* * * * *